US006113625A

United States Patent [19]

Foley

[11] Patent Number: 6,113,625

[45] Date of Patent: Sep. 5, 2000

[54] NIPPLE FEEDER ARRANGEMENT

[76] Inventor: Mark Foley, P.O. Box 50, Conway, Mich. 49722

[21] Appl. No.: 09/338,373

[22] Filed: Jun. 23, 1999

[51] Int. Cl.[7] ..... A61J 17/00

[52] U.S. Cl. ..... 606/236

[58] Field of Search ..... 215/11 R; 606/234, 606/235, 236

[56] References Cited

U.S. PATENT DOCUMENTS

| | | | |
|---|---|---|---|
| 3,263,848 | 8/1966 | Zackheim | 215/11 |
| 3,790,016 | 2/1974 | Kron | 215/11 R |
| 4,301,934 | 11/1981 | Forestal | 215/11 D |
| 4,994,076 | 2/1991 | Guss | 606/236 |
| 5,049,127 | 9/1991 | Yen Tseng | 604/79 |
| 5,421,496 | 6/1995 | Korsinsky et al. | 224/148 |

*Primary Examiner*—Michael Buiz
*Assistant Examiner*—Vy Q. Bui
*Attorney, Agent, or Firm*—Henderson & Sturm LLP

[57] ABSTRACT

A nipple feeder arrangement 10 employed as a low cost substitute for a prior art supplemental breast feeding system 100 wherein the nipple feeder arrangement 10 can be employed with a variety of conventional liquid feeding components such as a hollow feeding tube 40 a feeder tube connector 50 a liquid supply container 110 and a nipple locking collar member 30 and comprises an integrally formed flexible nipple member 20 having an upper end provided with a nipple extension element 23 an intermediate portion provided with a recess 25 having a vent aperture 26 that can be sealingly engaged with the liquid supply container 110.

8 Claims, 1 Drawing Sheet

NIPPLE FEEDER ARRANGEMENT

BACKGROUND OF THE INVENTION

1. Field of the Invention

The present invention relates to the field of nipple feeding arrangements in general and in particular to a low cost substitute for an existing nipple feeding system.

2. Description of Related Art

Medela Inc., has recently developed a supplemental breast feeding system which is marketed under the trademark Medela Starter SNS and which employs a one-piece teat-tubing assembly which comprises a bottle top closure element adapted to engage the top of a bottle containing a supply of mother's milk or a feeding supplement and which is provided with an integrally formed elongated length of flexible tubing; and, a disk valve which rests on top of the supplemental feeding supply bottle and which is captively engaged to the top of the supply bottle by the bottle top closure element to vent the interior of the supply bottle as the contents of the supply bottle are being consumed by the infant.

While the aforementioned prior art construction is more than adequate for the basic purpose and function for which it has been specifically designed, this particular system is very costly to manufacture due to the one-piece construction of the teat-tubing assembly and the specialized design of the two-piece disk valve.

While many mothers would undoubtedly receive substantial benefit from employing the supplemental feeding system that has been developed by Medela Inc.; unfortunately, the cost of this system has put this product out of the range of many low and middle income mothers.

As a consequence of the foregoing situation, there has existed a need for a new and improved low cost substitute for the Medela supplemental feeding systems which employs a large number of low cost commercially available components in conjunction with a single custom made component to duplicate the function of the Medela system; and, the provision of such a low cost nipple feeder arrangement.

BRIEF SUMMARY OF THE INVENTION

Briefly stated, the nipple feeder arrangement that forms the basis of the present invention comprises a single custom made nipple unit which cooperates with a variety of commercially fluid available feeding components to provide a low-cost alternative to the Medela supplemental breast feeding systems; wherein, the custom made nipple unit may assume two different configurations.

As will be explained in greater detail further on in the specification, in one version of the preferred embodiment, the custom made nipple unit comprises an integrally formed nipple assembly which incorporates a bottle engaging locking collar with a customized nipple member; and in the other version of the preferred embodiment, the customized nipple member is captively engaged by a separate bottle engaging collar member.

However, in both versions of the preferred embodiment, the customized nipple member is provided with an integrally formed vented recess and an integrally formed nipple extension wherein the nipple extension is adapted to be releasably connected to a commercially available feeding tube member; and the end result of this nipple feeder arrangement is a low cost, structurally distinct yet functionally equivalent alternative to the Medela supplemental breast feeding system.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
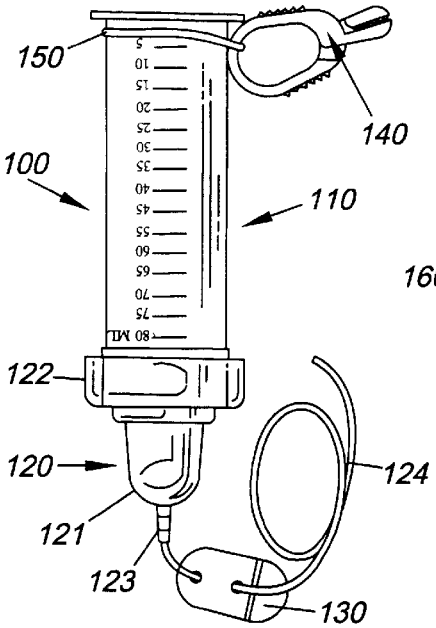
PRIOR ART Fig. 1
FIG. 1 is a depiction of the prior art supplemental breast feeding system.
Figure 2:
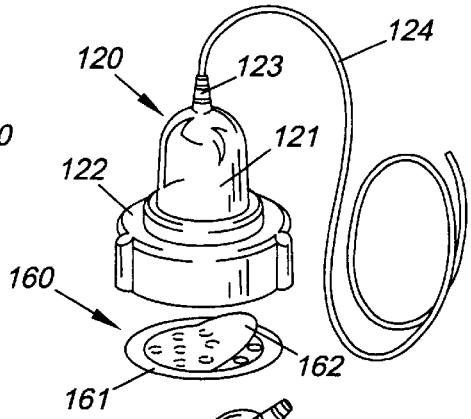
PRIOR ART Fig.2
FIG. 2 is a depiction of the prior art teat-tubing assembly.

The prior art supplemental breast feeding system is depicted in its entirety in FIG. 1 and the integrally formed teat-tubing assembly is shown in FIG. 2. This prior art system is designated generally as 100 and comprises in general a conventional liquid supply container 110, a one-piece teat-tubing assembly 120, a tubing clamp 130, a quick clip 140, and an elastic ring 150, which comprise all of the components of the Medela, Inc. supplemental breast feeding system 100.

The two most expensive components of the prior art system 100 are depicted in FIG. 2 and comprise the integrally formed teat-tubing assembly 120 and the valve disk 160. The teat-tubing assembly 120 comprises a generally rigid nipple member 121 having an integrally formed locking skirt element 122 which is adapted to sealingly engage the top of the conventional liquid supply container 110 in a well-recognized fashion.

In addition, the top of the rigid nipple member 121 is provided with an integrally formed hollow nipple extension element 123 which is integrally formed with a length of flexible feeder tubing 124.

Still referring to FIG. 2, it can be seen that the prior art valve disk 160 comprises an apertured rigid disk 161 provided with a resilient flap valve 162 for venting the interior of the liquid supply container.

Given the complexity involved in the manufacturing of the components 120 and 160 of the prior art supplemental breast feeding system 100, it is not surprising that this system 100 is expensive to purchase.

Figure 3:
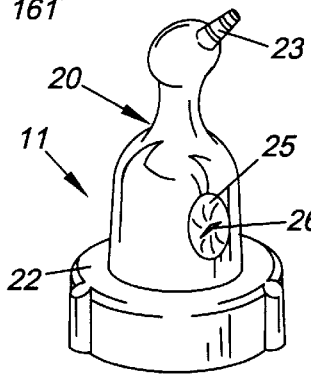
FIG. 3 is an isolated perspective view of one version of the customized nipple member employed in this invention.
Figure 4:
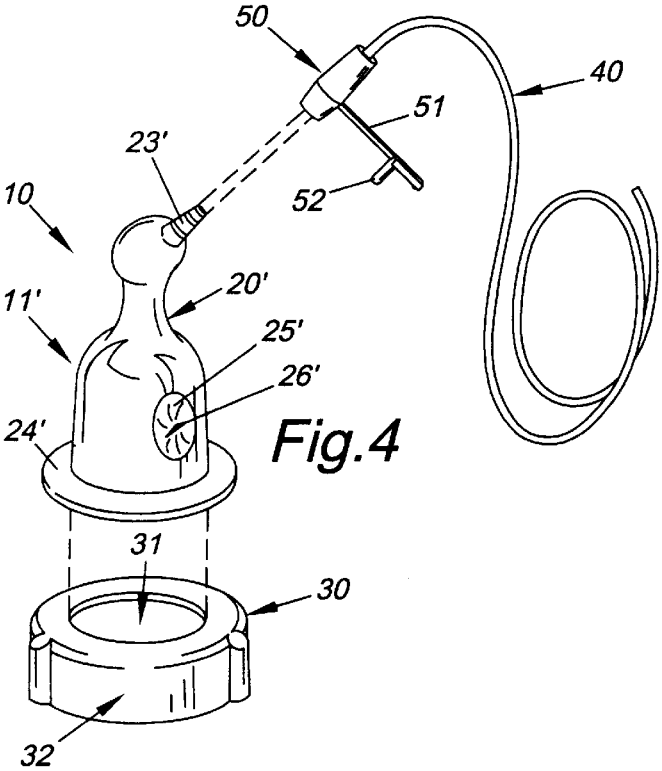
FIG. 4 is an exploded perspective view of another version of the customized nipple member in conjunction with other commercially available components that may be employed in the nipple feeder arrangement.
Figure 5:
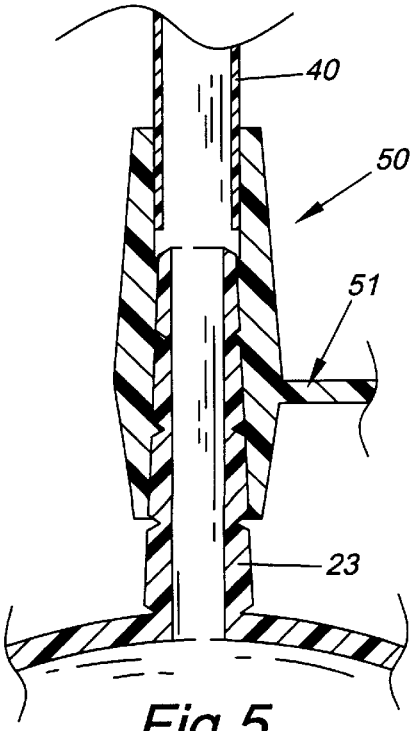
FIG. 5 is an isolated cross-sectional view showing the engagement between the nipple extension element and the feeder tube arrangement employed in this invention.

Turning now to FIGS. 3 through 5, it can be seen that the nipple feeding system that forms the basis of the present invention is designated generally by the reference numeral 10 and comprises in general a customized nipple unit 11 which is employed in conjunction with a variety of conventional components such as the liquid supply container 110.

As can be seen by reference to FIG. 3 in the first version of the preferred embodiment the customized nipple unit 11 comprises a generally flexible nipple member 20 having a ridged hollow nipple extension element 23 integrally formed on the upper end, a downwardly depending locking collar element 22 integrally formed on the lower end and a recess 25 provided with a vent aperture 26 integrally formed on the intermediate portion of the nipple member 20.

Turning now to FIG. 4, it can be seen that in the second version of the preferred embodiment, the customized nipple unit 11' comprises a generally flexible nipple member 20' having a ridged hollow nipple extension element 23' integrally formed on the upper end, an outwardly flared skirt element 24' integrally formed on the lower end, and a recess 25' provided with a vent aperture 26' integrally formed on the intermediate portion of the nipple member 20'.

In this version of the preferred embodiment, the outwardly flared skirt element 24'of the nipple member 20' is dimensioned to be captively engaged by a conventional nipple locking collar member 30 having a central aperture 31 dimensioned to receive the nipple member 20' and a downwardly depending portion 32 adapted to engage the conventional liquid supply container 110 in a well recognized manner to captively engage the flared skirt element 24' between the interior of the nipple collar member 30 and the top of the liquid supply container 110.

Turning now to FIGS. 4 and 5, it can be seen that in both versions of the preferred embodiment, the ridged nipple extension element 23, 23' is adapted to be operatively attached to a length of conventional feeding tube 40 such as French feeding tube no. 5 by a conventional tubing connector member 50 having an upper end dimensioned to receive feeding tube 40 and a lower end dimensioned to frictionally engage the tapered ridged nipple extension element 23, 23' of nipple members 20 and 20' respectively.

In addition, as shown in FIG. 4, the connector member 50 is provided with an elongated flexible extension arm 51 provided with a closure element 52 that can sealingly engage the lower end of the connector member 50 when the connector member 50 is not operatively engaged with one of the nipple extension elements 23 or 23'.

By now, it should be appreciated that given the unique construction of the two versions of the preferred embodiment, the nipple members 20, 20' allow a member of conventional components 30, 40 and 50 to be employed in the nipple feeding system 10 of this invention; and, by incorporating the recessed vent aperture 26, 26' directly into the nipple members 20, 20'; the need for a separate valve mechanism 160 has been eliminated.

As a consequence of the foregoing situation, a low cost nipple feeder arrangement has been developed as an economical alternative to the expensive prior art supplemental breast feeding system discussed previously.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A nipple feeder arrangement for use with selected feeding components including a length of hollow feeding tube; a feeder tube connector adapted to releasably engage the hollow feeding tube; a liquid supply container; and, a nipple locking collar member adapted to engage the liquid supply container and provided with a central opening; wherein, the nipple feeder arrangement comprises:

a customized nipple including a generally integrally formed flexible thin walled nipple member having an upper end, a lower end and intermediate portion; wherein the upper end is provided with a hollow nipple extension element and the intermediate portion is provided with an inwardly curved recess having a centrally disposed vent aperture.

2. The arrangement as in claim 1; wherein, the nipple extension element is adapted to be releasably engaged by the feeder tube connector.

3. The arrangement as in claim 2; wherein, the nipple extension element is tapered.

4. The arrangement as in claim 3; wherein, the nipple extension element is ridged.

5. The arrangement as in claim 2; wherein, the nipple extension element is ridged and tapered.

6. The arrangement as in claim 2; wherein, the lower end of the nipple member is provided with a locking collar element which is adapted to sealingly engage the liquid supply container.

7. The arrangement as in claim 2; wherein, the upper end and the intermediate portion of the nipple member are dimensioned to pass through the central opening in the nipple locking collar member.

8. The arrangement as in claim 7; wherein, the lower end of the nipple member is provided with an outwardly flared skirt element which is adapted to be captively engaged between the nipple locking collar member and the liquid supply container.

* * * * *